US010278000B2

(12) United States Patent
Breebaart et al.

(10) Patent No.: US 10,278,000 B2
(45) Date of Patent: Apr. 30, 2019

(54) AUDIO OBJECT CLUSTERING WITH SINGLE CHANNEL QUALITY PRESERVATION

(71) Applicant: Dolby Laboratories Licensing Corporation, San Francisco, CA (US)

(72) Inventors: Dirk Jeroen Breebaart, Ultimo (AU); Lianwu Chen, Beijing (CN); Lie Lu, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 38 days.

(21) Appl. No.: 15/375,488

(22) Filed: Dec. 12, 2016

(65) Prior Publication Data

US 2017/0171687 A1 Jun. 15, 2017

Related U.S. Application Data

(60) Provisional application No. 62/266,842, filed on Dec. 14, 2015.

(30) Foreign Application Priority Data

Dec. 14, 2015 (CN) ..... 2015 1 0916523

(51) Int. Cl.
*H04S 7/00* (2006.01)

(52) U.S. Cl.
CPC ..... *H04S 7/30* (2013.01); *H04S 2400/11* (2013.01); *H04S 2400/13* (2013.01)

(58) Field of Classification Search
CPC . H04S 7/308; H04S 7/30; H04S 3/008; H04S 2400/11; H04S 2400/13; H04S 2420/13; H04R 5/02; H04R 5/04
(Continued)

(56) References Cited

U.S. PATENT DOCUMENTS

2014/0023196 A1 1/2014 Xiang
2014/0023197 A1* 1/2014 Xiang ..... H04S 1/007 381/17

(Continued)

FOREIGN PATENT DOCUMENTS

WO 2014/099285 6/2014
WO 2014/184353 11/2014

(Continued)

OTHER PUBLICATIONS

Kamado, N. et al "Object-Based Stereo Up-Mixer for Wave Field Synthesis Based on Spatial Information Clustering" IEEE Proc. of the 20th European Signal Processing Conference, Aug. 27-31, 2012, pp. 594-598.

(Continued)

*Primary Examiner* — Ahmad F. Matar
*Assistant Examiner* — Sabrina Diaz
(74) *Attorney, Agent, or Firm* — Fish & Richardson P.C.

(57) ABSTRACT

Example embodiments disclosed herein relate to audio object clustering with single channel quality preservation. A method of clustering audio objects is disclosed. The method includes determining cluster positions based on object positions of the audio objects and a reference speaker layout, the reference speaker layout indicating speakers located at different speaker positions. The method also includes determining object-to-cluster gains based on the determined cluster positions, the object positions and the reference speaker layout, an object-to-cluster gain defining a proportion of the respective audio object that is assigned to a cluster associated with one of the determined cluster positions. The method further includes clustering the audio objects based on the object-to-cluster gains and the cluster positions for generating cluster signals. Corresponding sys-
(Continued)

tem, computer program product and device for clustering audio objects are also disclosed.

16 Claims, 5 Drawing Sheets

(58) Field of Classification Search
USPC ..... 381/303, 300
See application file for complete search history.

(56) References Cited

U.S. PATENT DOCUMENTS

| | | | |
|---|---|---|---|
| 2014/0358541 | A1 | 12/2014 | Colibro |
| 2015/0235645 | A1 | 8/2015 | Hooks et al. |
| 2015/0332680 | A1 | 11/2015 | Crockett |

FOREIGN PATENT DOCUMENTS

| | | |
|---|---|---|
| WO | 2014/187990 | 11/2014 |
| WO | 2014/187991 | 11/2014 |
| WO | 2015/017037 | 2/2015 |
| WO | 2015/017235 | 2/2015 |
| WO | 2015/105748 | 7/2015 |
| WO | 2015/130617 | 9/2015 |

OTHER PUBLICATIONS

Herre, J. et al "MPEG-H 3D Audio—The New Standard for Coding of Immersive Spatial Audio" IEEE Journal of Selected Topics in Signal Processing, vol. 9, Issue 5, Aug. 2015, pp. 770-779.

* cited by examiner

AUDIO OBJECT CLUSTERING WITH SINGLE CHANNEL QUALITY PRESERVATION

CROSS REFERENCE TO RELATED APPLICATIONS

This application claims the benefit of priority to U.S. Provisional Patent Application Ser. No. 62/266,842, and International Patent Application Ser. No. 201510916523.5 filed on Dec. 14, 2015, which is hereby incorporated herein by reference in its entirety.

TECHNOLOGY

Example embodiments disclosed herein generally relate to object-based audio processing, and more specifically, to a method and system for audio object clustering with single channel quality preservation.

BACKGROUND

Traditionally, audio content of multi-channel format (for example, stereo, 5.1, 7.1, and the like) is created by mixing different audio signals in a studio, or generated by recording acoustic signals simultaneously in a real environment. More recently, object-based audio content has become more and more popular as it carries a number of audio objects and audio beds separately so that it can be rendered with much improved precision compared with traditional rendering methods. As used herein, the term "audio object" refers to individual audio elements that may exist for a defined duration of time but also has associated metadata describing spatial information such as the position, velocity, and size of each object. As used herein, the term "audio bed" or "bed" refers to audio channels that are meant to be reproduced in predefined and fixed speaker locations.

For example, cinema sound tracks may include many different sound elements corresponding to images on the screen, dialogs, noises, and sound effects that emanate from different places on the screen and combine with background music and ambient effects to create the overall auditory experience. Accurate playback requires the sounds to be reproduced in such a way that corresponds as closely as possible to what is shown on screen with respect to sound source position, intensity, movement, and depth.

During transmission of audio signals, beds and objects can be sent separately and then used by a spatial reproduction system to recreate the artistic intent using a variable number of speakers in known physical locations. In some situations, there may be tens or even hundreds of individual audio objects contained in the audio content. Such object-based audio content has significantly increased the complexity of rendering audio data within playback systems.

The large number of audio signals in the object-based content poses new challenges for the coding and distribution of such content. In some distribution and transmission systems, a transmission capacity may be provided with large enough bandwidth available to transmit all audio beds and objects with little or no audio compression. However, in some cases such as distribution via Blu-ray disc, broadcast (cable, satellite and terrestrial), mobile (3G, 4G as well as 5G), or over-the-top (OTT, or the Internet), the available bandwidth is insufficient to transmit information concerning all of the beds and objects created by an audio mixer. While audio coding methods (lossy or lossless) may be applied to the audio to reduce the required bandwidth, transmission bandwidth is usually still a bottleneck, especially for those networks with very limited bandwidth resources such as 3G, 4G as well as 5G mobile systems.

SUMMARY

Example embodiments disclosed herein propose a solution for audio object clustering with single channel quality preservation.

In one aspect, example embodiments disclosed herein provide a method of clustering audio objects. The method includes determining cluster positions based on object positions of the audio objects and a reference speaker layout, the reference speaker layout indicating speakers located at different speaker positions. The method also includes determining object-to-cluster gains based on the determined cluster positions, the object positions and the reference speaker layout, an object-to-cluster gain defining a proportion of the respective audio object that is assigned to a cluster associated with one of the determined cluster positions. The method further includes clustering the audio objects based on the object-to-cluster gains and the cluster positions for generating cluster signals. Embodiments in this regard further provide a corresponding computer program product.

In another aspect, example embodiments disclosed herein provide a system for clustering audio objects. The system includes a cluster position determining unit configured to determine cluster positions based on object positions of the audio objects and a reference speaker layout, the reference speaker layout indicating speakers located at different speaker positions. The system also includes an object-to-cluster gain determining unit configured to determine object-to-cluster gains based on the determined cluster positions, the object positions and the reference speaker layout, an object-to-cluster gain defining a proportion of the respective audio object that is assigned to a cluster associated with one of the determined cluster positions. The system further includes a cluster signal generating unit configured to cluster the audio objects based on the object-to-cluster gains and the cluster positions for generating cluster signals.

In yet another aspect, example embodiments disclosed herein provide a device. The device includes a processing unit, and a memory storing instructions that, when executed by the processing unit, cause the device to perform the method as described above.

Through the following description, it would be appreciated that in accordance with example embodiments disclosed herein, cluster positions are determined based on one or more reference speaker layouts and object positions of audio objects in order to restrict the cluster positions not far away from some speakers within the reference speaker layouts. In this manner, all the speakers may be addressable if it is required for the audio objects under processing, thereby preserving the single channel quality. Moreover, the determined cluster positions are not specific to the used reference speaker layouts, but can be varied by the input audio objects, thereby ensuring flexibility of the subsequent rendering. Based on the determined cluster positions, the object positions and the reference speaker layout, object-to-cluster gains may then be estimated for grouping the audio objects into clusters. Other advantages achieved by example embodiments disclosed herein will become apparent through the following descriptions.

DESCRIPTION OF DRAWINGS

Through the following detailed description with reference to the accompanying drawings, the above and other objectives, features and advantages of example embodiments disclosed herein will become more comprehensible. In the drawings, several example embodiments disclosed herein will be illustrated in an example and non-limiting manner, wherein.

Throughout the drawings, the same or corresponding reference symbols refer to the same or corresponding parts.

DESCRIPTION OF EXAMPLE EMBODIMENTS

Figure 1:
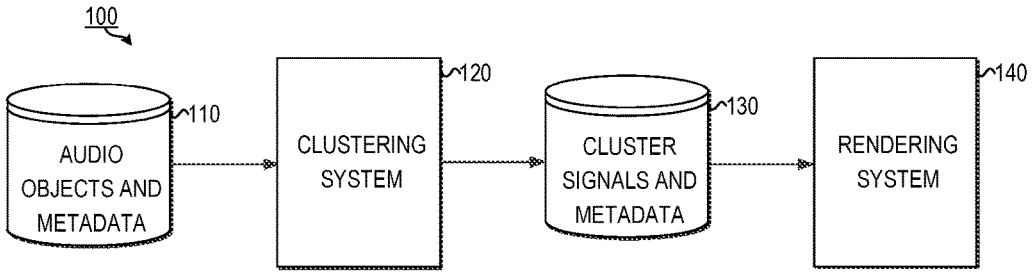
Fig. 1 PRIOR ART
FIG. 1 is a block diagram of an example object-based audio signal processing framework.

Principles of example embodiments disclosed herein will now be described with reference to various example embodiments illustrated in the drawings. It should be appreciated that depiction of those embodiments is only to enable those skilled in the art to better understand and further implement example embodiments disclosed herein, not intended for limiting the scope disclosed herein in any manner.

As used herein, the term "includes" and its variants are to be read as open-ended terms that mean "includes, but is not limited to." The term "or" is to be read as "and/or" unless the context clearly indicates otherwise. The term "based on" is to be read as "based at least in part on." The term "one example embodiment" and "an example embodiment" are to be read as "at least one example embodiment." The term "another embodiment" is to be read as "at least one other embodiment".

As used herein, the terms "clustering" and "grouping" or "combining" are used interchangeably to describe the combination of objects and/or beds (channels) into "clusters," in order to reduce the amount of audio objects for transmission and rendering in an adaptive audio playback system. As used herein, the term "rendering" or "panning" may refer to a process of transforming audio objects or clusters into speaker feed signals for a particular playback system. The term "address" and its variants are used to describe that a cluster or an audio object is rendered over one or more of speakers in a playback system during the rendering process.

In typical object-based audio signal processing frameworks, in order to reduce computational complexity, storage requirements and transmission bandwidth requirements, input audio objects are clustered into a number of clusters to generate a reduced amount of audio signals (also referred to as cluster signals). The cluster signals may then be stored or transmitted to a render in a playback environment. FIG. 1 depicts a block diagram of an example object-based audio signal processing framework 100. As shown, the framework 100 includes a block 110 used to produce a large number of audio objects and associated metadata for creating object-based audio content, a clustering system 120 used to cluster the audio objects, a block 130 used to output the generated cluster signals and associated metadata, and a rendering system 140 used to render the cluster signals to speakers included in an audio playback system.

The clustering system 120 may obtain a set of N audio objects and their associated metadata from the block 110, and perform an audio object clustering process that produces M clusters signals from the N audio objects based on the metadata, where M is a number that is not larger than N. The clustering system 120 may also generate metadata for the cluster signals, for example, by merging metadata of the audio objects clustered in the respective cluster signals. The M cluster signals and their associated metadata may be distributed by the block 130 to the rendering system 140. The rendering system 140 is placed at a playback environment and used to render the cluster signals to speakers within the playback environment based on their associated metadata.

The block 110 may further provide audio beds for the object-based audio content. In some examples, the audio beds may be regarded as one or more audio objects with fixed object positions and thus clustered in the clustering system 120 with the other audio objects. In other examples, the audio beds may be directly transmitted to the rendering system 140 for rendering without extra processing.

If the audio objects are clustered, for example, based on their positions, the audio quality (especially the single channel quality) may be degraded when the generated cluster signals are rendered to a given speaker layout. Some speaker channels may be masked (inactive) after clustering of the audio objects. Due to the dynamic audio objects, there may be artifacts in one or more speaker channels that are masked in the overall presentation but become audible if the speaker channels are soloed.

Figure 2:
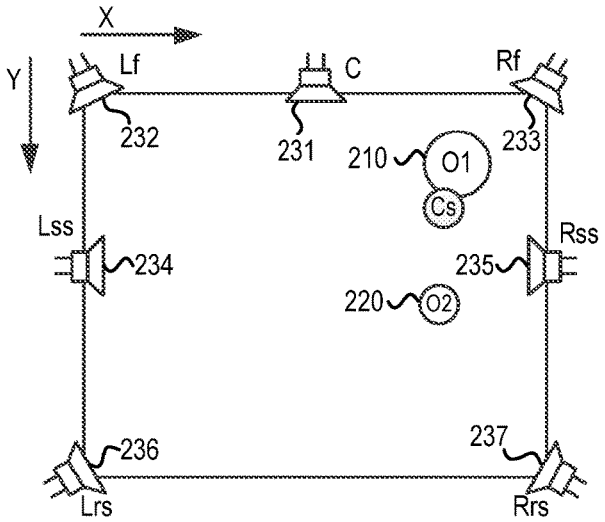
Fig. 2 PRIOR ART
FIG. 2 is a schematic diagram of an example clustering of audio objects in a speaker layout.

FIG. 2 shows example clustering of audio objects in a speaker layout. In this example, two audio objects 210 and 220 are grouped to a cluster to generate a cluster signal Cs, where the object 210 has larger energy or higher perceptual importance than the object 220. The cluster signal Cs is rendered in a floor speaker layout with seven speakers, including a center (C) speaker 231, a left-front (Lf) speaker 232, a right-front (Rf) speaker 233, a left-side-surround (Lss) speaker 234, a right-side-surround (Rss) speaker 235, a left-rear-surround (Lrs) speaker 236, and a right-rear-surround (Rrs) speaker 237. Such rendering process may include amplitude-based panning in which the cluster signal Cs is distributed over one or more speakers, such that the perceived location of the cluster signal Cs is equal or close to its cluster position. Panning gains can be obtained by pair-wise panning, center-of-mass panning, and triangulation such as in vector-based amplitude panning (VBAP), for example.

In the rendering process, one possible way is to use a subset of all the available speakers to reproduce the cluster signal Cs. Usually a subset of speakers that are relatively closed to the cluster position of the cluster signal Cs is used. For example, a triangulation-based panning method such as VBAP may pan the cluster signal Cs across C, Rf, and Rss speakers 231, 233 and 235. Some other panning methods may also include Lss speaker 234. However, Lrs and Rrs speakers 236 and 237 are typically excluded from the panning because these speakers have no foreseeable contribution for reproducing the cluster signal Cs at its intended position.

That is, Lrs and Rrs speakers 236 and 237 are active before the clustering (due to the position of the object 220) but become inactive after the clustering. Moreover, when the large-energy audio object 210 is dynamic, for example, it disappears for a time and then appears again, the cluster position of the cluster signal Cs may be changed from the current position to the position of the object 220 and back to the current position again. Correspondingly, Lrs and Rrs speakers 236 and 237 may alternate between being active and inactive. Such discontinuity may be audible, especially when the channels of these speakers are soloed.

It is desirable to avoid discontinuity artifacts and preserve single channel quality in audio object clustering so as to make sure that each speaker is addressable by at least one cluster. One possible way is to simply render audio objects into a reference speaker layout (e.g. a 7.1.4 speaker layout), and then take the signals rendered at each speaker within the layout as the resulting (static) cluster signals. However, this may result in some problems. For example, the resulting cluster signals are only optimal to the specific reference speaker layout but not for other speaker layouts. Moreover, the overall perceived quality will be decreased much in headphone rendering if compared to the results generated by some typical audio object clustering schemes.

In order to keep the rendering flexibility (for example, to have a cluster representation that is speaker-layout agnostic) while avoiding discontinuity artifacts and preserving single channel quality, dynamic clusters (which move over time) are practical rather than static clusters (e.g. rendered channels). Example embodiments disclosed herein propose an improved solution for audio object clustering with single channel quality preservation. During the audio object clustering process, cluster positions are determined based on one or more reference speaker layouts and object positions of audio objects. This can prevent the cluster positions from being far away from some speakers within the reference speaker layouts. In this way, all the speakers may be addressable if it is required for the audio objects under processing, thereby preserving the single channel quality. Moreover, the cluster positions are not specific to the used reference speaker layouts, but are varied by the actual audio objects to be clustered. Based on the cluster positions, object-to-cluster gains may then be estimated for grouping the audio objects into clusters.

Figure 3:
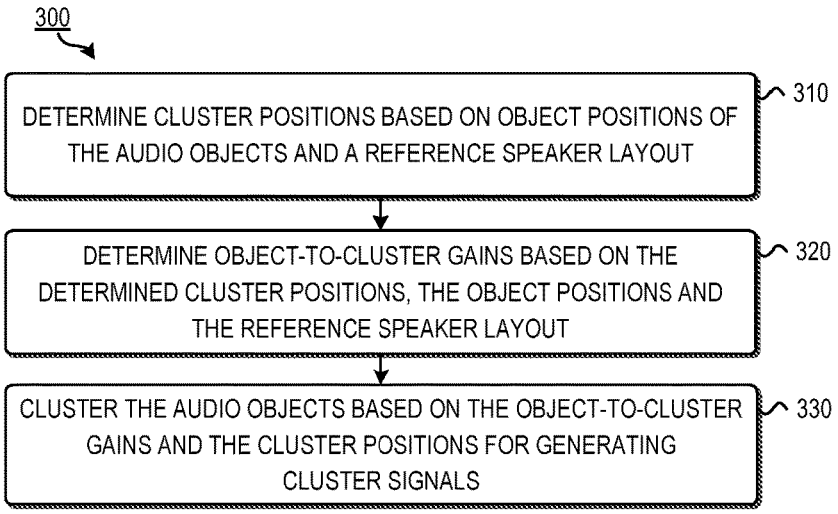
FIG. 3 is a flowchart of a process of clustering audio objects in accordance with one example embodiment disclosed herein.

FIG. 3 depicts a flowchart of a process of clustering audio objects 300 in accordance with one example embodiment disclosed herein. In general, the process 300 involves a step 310 of determining clustering positions and a step 320 of determining object-to-cluster gains. Based on the determined clustering positions and object-to-cluster gains, audio objects are grouped into a reduced number of clusters to generate cluster signals in step 330. Each of the audio objects can be assigned to one of the clusters with an object-to-cluster gain. The number of the clusters may be predetermined or configured based on some strategies and generally is smaller than that of the audio objects.

As shown, in step 310, cluster positions are determined based on object positions of the audio objects and a reference speaker layout. The audio objects are those to be stored or transmitted to the audio playback systems for rendering. In order to reduce the complexity of storing, transmitting, and/or rendering, it is desired to perform audio object clustering first. In some example embodiments, the audio objects have associated metadata describing their spatial information such as the positions, velocities, and sizes. In some cases, a number of audio beds may also be stored or transmitted along with the audio objects in order to reproduce object-based audio. The audio beds, in one example, may be regarded as one or more audio objects with fixed object positions in the audio object clustering process. Alternatively, the audio beds may not be processed in the clustering process, but will be directly stored or transmitted along with the clustered signals.

Each reference speaker layout specifies a possible distribution of speakers in the audio playback environment. For example, the reference speaker layout may indicate speakers located at different speaker positions. According to example embodiments disclosed herein, the reference speaker layout can be used to prevent the case where all the cluster positions are far away from one speaker or some speakers, thereby ensuring high single channel quality. Examples of the reference speaker layout include, but are not limited to, a 5.1 speaker layout, a 7.1.4 speaker layout, or a 7.1.6 speaker layout. It will be appreciated that any other speaker layouts may also be used. In some embodiments, multiple reference speaker layouts may be considered in determining the cluster positions.

To determine the cluster position, in some example embodiments disclosed herein, initial cluster positions may be first determined based on the reference speaker layout. Then, the cluster positions for clustering the audio objects may be updated from the initial cluster positions based on the object positions of the audio objects. In one embodiment, the initial cluster positions may be determined based on the speaker positions in the reference speaker layout such that each of the speakers in the speaker layout is addressed by at least one of the clusters associated with the initial cluster positions. In this case, the reference speaker layout may be selected by considering the predetermined number of clusters in some embodiments. For example, if it is intended to allocate the audio objects into eleven clusters, then a 7.1.4 speaker layout may be used to initialize cluster positions of those clusters, and each cluster may be initially positioned at one of the 7 floor speakers and 4 ceiling speakers. As known, the only one bass speaker in the 7.1.4 speaker layout may not be used to render the cluster signals. Therefore, in some embodiments, the bass speaker is not considered. In some embodiments, the cluster positions and the speaker positions of the reference speaker layout may be represented in the same coordinate system, for example, a Descartes coordinate system.

Figure 4A:
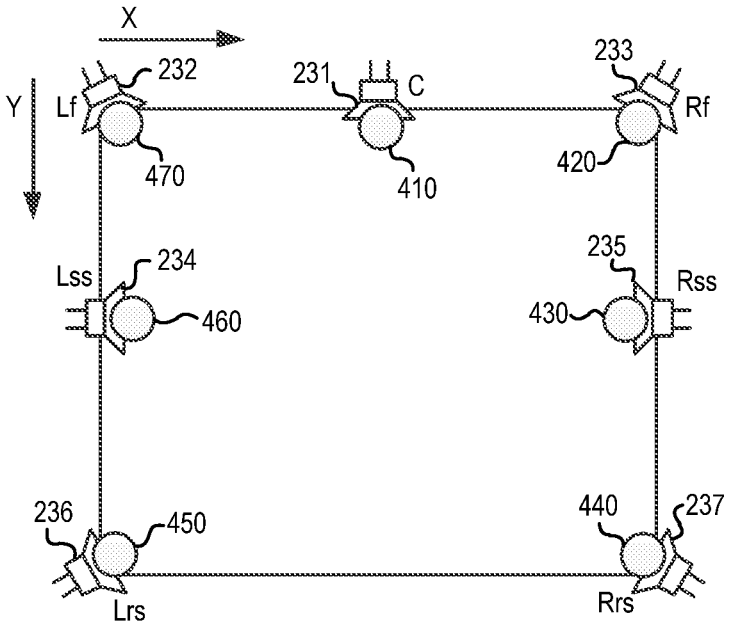
FIGS. 4A-4B are schematic diagrams of example initial cluster positions in accordance with example embodiments disclosed herein.

FIG. 4A depicts an illustrative example of initial cluster positions in a reference speaker layout including seven floor speakers C, Lf, Rf, Lss, Rss, Lrs, and Rrs 231-237. As shown, cluster positions of seven clusters 410-470 among all eleven possible clusters are initialized at those speakers 231-237, respectively. It is noted that FIG. 4A only shows the floor layout in this reference speaker layout. Some other initial cluster positions may be set at the ceiling speakers of this speaker layout.

In some embodiments where multiple different reference speaker layouts are used in the cluster position determination, the initial cluster positions may be determined by jointly considering speaker positions in these layouts, for example, by weighting the speaker positions. In one example where a 5.1.4 speaker layout and a 7.1.6 speaker layout are both used as reference speaker layouts, one cluster may be initially located in the middle of the center speaker locations in the 5.1.4 speaker layout and the 7.1.6 speaker layout. Other initial cluster positions may be determined in a similar way. The speaker positions of the two reference speaker layouts may be normalized in this example.

Considering that the cluster signals may be rendered over multiple speakers, the initial cluster positions may be set to other positions than the speaker positions. In some example embodiments disclosed herein, an area associated with the reference speaker layout may be divided into a plurality of subareas and the initial cluster positions may be set based on locations of the subareas such that each of the speakers in the speaker layout is addressed by at least one of the clusters associated with the initial cluster positions. For example, one or more initial clusters may be positioned in each of the divided subareas. The initial cluster positions may be set as the centroid positions of the subareas and/or some random positions in the subareas. It is noted that it is not necessary to position at least one initial cluster in each subarea as long as all of the speakers are addressed by well-known panning techniques based on the initial cluster positions.

In one embodiment, the area of the reference speaker layout may be divided based on a distribution of the audio objects in the area. Depending on the distribution, the area associated with the reference speaker layout may be divided into several even subareas or uneven subareas. For example, a dense region in the area with a large number of audio objects may be divided into multiple smaller subareas. A sparse region with few objects may be regarded as one subarea, or may be divided some large subareas.

Alternatively, or in addition, the area of the reference speaker layout may be divided based on perceptual importance of the audio objects. The perceptual importance of an audio object may be measured by its energy (amplitude), loudness, partial loudness, and/or the like. For example, an audio object with higher energy (amplitude), loudness, and/or partial loudness may be considered to have higher perceptual importance. If a region in the area has audio objects with high perceptual importance located, this region can be divided into multiple smaller subareas. On the other hand, if a region in the area contains audio objects with lower perceptual importance, this region can be divided into a few subareas or not divided at all. In other words, if the perceptual importance of audio objects in a region is high, more initial clusters are positioned in this region.

In some other example embodiments, the area of the reference speaker layout may be directly divided into multiple even subareas, and the initial clusters may be evenly distributed in those subareas. In one example, the number of the divided subareas may be configured as the number of the clusters and then each initial cluster may be positioned in one of the subareas.

In some cases where multiple reference speaker layouts are used, the initial cluster positions may be determined based on multiple subareas divided in areas of those layouts. For example, by overlapping the areas of those layouts, the respective cluster position may be initialized by determining a position in the divided subareas of those different layouts.

Figure 4B:
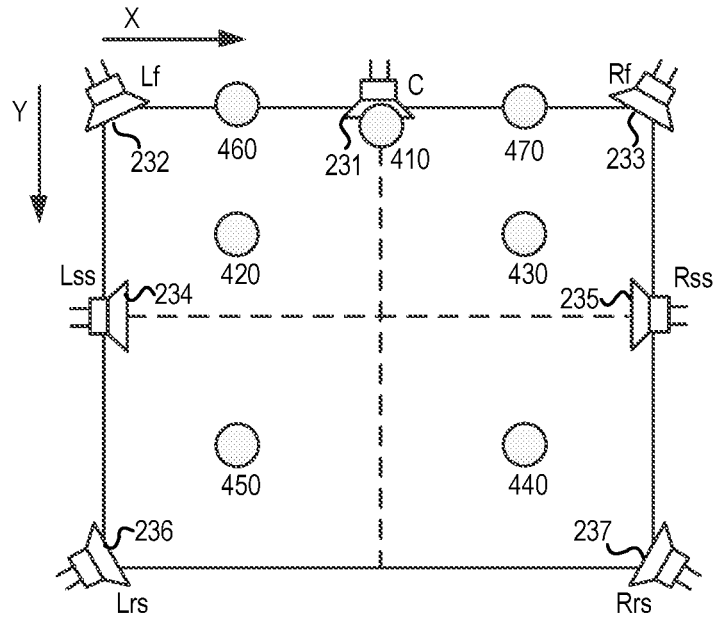

It would be appreciated that the initial cluster positions may be set based on both the speaker positions and the subarea division. For example, some of the initial cluster positions may be directly set as the speaker positions, and some other initial cluster positions may be determined based on the divided subareas. In some other examples, some or all of the initial cluster positions may be randomly set in the area of the reference speaker layout. FIG. 4B depicts a schematic diagram of initial cluster positions that are set based on such a mixing manner. As shown, the area of the reference speaker layout is divided into four subareas. When initializing the cluster positions, an initial cluster 410 is positioned at the center speaker 231, and four initial clusters 420-450 are set in the center of the four divided subareas. Clusters 460 and 470 are initialized between the Lf and Rf speakers 232 and 233.

Although the cluster positions initialization based on the reference speaker layout(s) will make sure that each speaker can be addressable by at least one cluster, the layout-specific cluster positions may result in that the audio object clustering is optimal to the used reference speaker layout(s) only, which, as mentioned, is not desirable. In example embodiments disclosed herein, the cluster positions to be used for clustering the audio objects are further updated from the initial cluster positions based on the object positions of the audio objects. In this manner, the clusters are adapted with the dynamic audio objects. It can be seen that there is a tradeoff between the initial cluster positions and the cluster positions adapted based on the object positions. It is desired to avoid the updated cluster position moving far from the initial cluster position.

In some example embodiments disclosed herein, an initial clustering may be performed on the audio objects based on the initial cluster positions as well as the object positions of the audio objects. In the initial audio object clustering, many panning techniques may be used to pan each of the audio objects into the initial clusters associated with the initial cluster positions. Examples of panning techniques include, but are not limited to, VBAP, Center of Mass Amplitude Panning (CMAP), pair-wise panning, and center-of-mass panning. Any other panning techniques, either currently known or to be developed in the future, can be adopted to cluster the audio objects to the initial clusters. The proportion of the respective audio object that is assigned to an initial cluster may be represented as an object-to-cluster gain. In some examples, an object-to-cluster gain may be estimated through a distance difference between the object position of the corresponding audio object and the initial cluster position.

The object-to-cluster gains may be modified and then used to update the initial cluster positions. Some predetermined strategies may be utilized in modifying the object-to-cluster gains. In some example embodiments, the object-to-cluster gains may be compressed with a predetermined compression factor such that the gains are nonlinearly modified. For example, the object-to-cluster gains may be mapped by an exponential function with the compression factor as the index, which can be expressed as follows:

$$g_{oc,inital}'=(g_{oc,inital})^{\alpha} \tag{1}$$

where $g_{oc,inital}$ represents an object-to-cluster gain for panning an audio object o to an initial cluster c during the initial audio object clustering, $\alpha$ represents the compression factor, and $g_{oc,inital}'$ represents the modified object-to-cluster gain. The compression factor $\alpha$ may be set to any value. In some examples, $\alpha$ may be set as a value larger than one, for example, 4.

Figure 5:
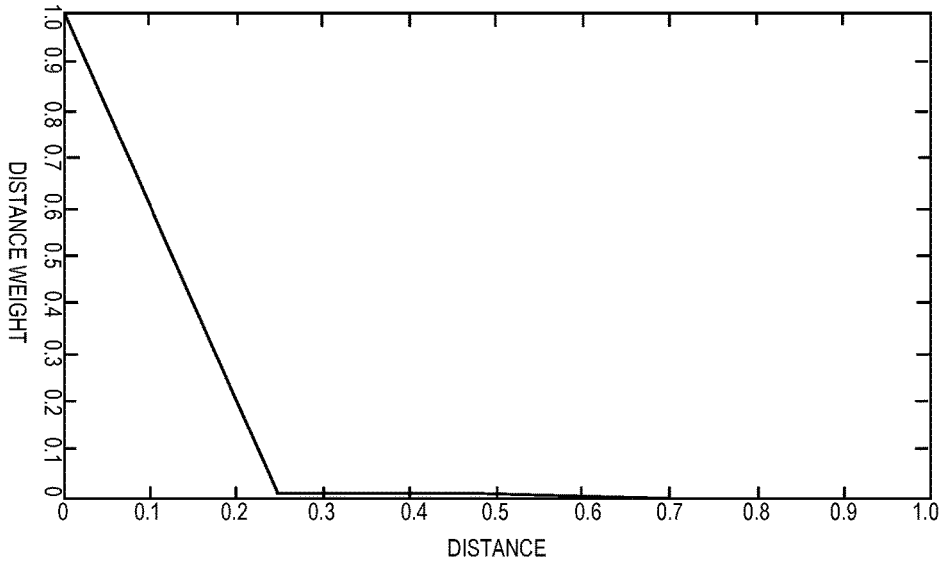
FIG. 5 is a schematic diagram showing a relationship between an object-to-cluster distance and a distance weight in accordance with one example embodiment disclosed herein.

Alternatively, or in addition, the object-to-cluster gains may be modified based on distance weights. A distance weight is used to ensure that audio objects located far from an initial cluster position will not contribute to the updating of cluster positions. That is, it is possible to make sure that a cluster will not move too far from the respective initial position. In some embodiments, the distance weights may be valued from 0 to 1, for example. In one embodiment, a distance weight for the respective object-to-cluster gain may be determined based on a distance between the initial cluster position of an initial cluster and the object position of an audio object corresponding to this gain. For example, the distance weight may be determined as a decrease function of the distance. FIG. 5 depicts an example relationship between the object-to-cluster distance and the distance weight. As can be seen, with the increase of the distance, the corresponding weight is decreased.

In some examples, the respective object-to-cluster gain may be weighted by the corresponding distance weight, as follows:

$$g_{oc,inital}'=g_{oc,inital}W_{d_{oc}} \tag{2}$$

where $g_{oc,inital}$ represents an object-to-cluster gain for panning an audio object o to an initial cluster c during the initial audio object clustering, $W_{d_{oc}}$ represents a distance weight based on the distance between the audio object o and the initial cluster c, and $g_{oc,inital}'$ represents the modified object-to-cluster gain.

In some other example embodiments disclosed herein, the object-to-cluster gains may be regularized in order to compensate for possible overlap of cluster positions. It is assumed that all the object-to-cluster gains are arranged as a matrix with the columns corresponding to respective clusters and the rows corresponding to the audio objects. If two or more columns of the matrix of object-to-cluster gain are closed to each other, it means that the corresponding initial clusters are closed to each other. In order to separate those initial clusters after updating the cluster positions based on the corresponding object-to-cluster gains, in one example embodiment, the matrix of object-to-cluster gains may be adjusted to increase a difference between two or more columns of object-to-cluster gains in this matrix.

Generally, if two or more columns in a matrix are closed, this matrix may not be inversed. Thus, it is possible to adjust the matrix of object-to-cluster gains with a penalization value, so as to increase the difference between the columns in this matrix and thus make the matrix invertible. The penalization value may have impact on the values of the object-to-cluster gains by using an identity matrix. In one example, the object-to-cluster gains may be adjusted based on the object-to-cluster gains obtained in the initial audio object clustering and a penalization coefficient, for example, as follows:

$$G_{oc,inital}'=(G_{oc,inital}G_{oc,inital}^{T}+\lambda I)^{-1}G_{oc,inital} \tag{3}$$

where $G_{oc,inital}$ represents a matrix of the object-to-cluster gains obtained in the initial audio object clustering, $\lambda$ represents a penalization coefficient, I represents an identity matrix, the superscript T represents a transposition operation, and $G_{oc,inital}'$ represents the adjusted matrix of object-to-cluster gains. The penalization coefficient may be set as a small value, for example, a value larger than 0.001 and smaller than 0.1.

Alternatively, or in addition, the object-to-cluster gains may be modified based on perceptual importance of the audio objects. For an audio object with higher perceptual importance, the corresponding object-to-cluster gain obtained from the initial audio object clustering may be increased, and for an audio object with lower perceptual importance, the object-to-cluster gain may be reduced. In one embodiment, the perceptual importance may be used as weights to adjust the respective object-to-cluster gains, as follows:

$$G^{oc,inital'}=E_oG_{oc,inital} \tag{4}$$

where $G_{oc,inital}$ represents a matrix of object-to-cluster gains obtained in the initial audio object clustering, $E_o$ represents a diagonal matrix with each diagonal element represents the perceptual importance of the respective audio object, and $G_{oc,inital}'$ represents the adjusted matrix of object-to-cluster gains. In some examples, the perceptual importance of all the audio objects may be normalized so that the perceptual importance sum of any one audio object in all the clusters is equal to 1.

In the above discussion, the object-to-cluster gains obtained from the initial audio object clustering are modified. The modified object-to-cluster gains may be used back to update the initial cluster positions. In one example embodiment, the initial cluster positions may be updated based on the modified object-to-cluster gains and the object positions of the audio objects, as below:

$$P_c=(G_{oc,inital}')^{T}P_o \tag{5}$$

where $P_c$ represents a cluster position matrix in which each row represents an updated cluster position of the respective cluster, $P_o$ represents an object position matrix in which each row represents an object position of the respective audio object, and $G_{oc,inital}'$ represents the adjusted matrix of object-to-cluster gains, and the superscript T represents a transposition operation. It is noted that if the cluster positions and the object positions are represented in a three-dimensional space, there may be three elements in each row of $P_c$ and $P_o$. The updated cluster positions may be used as the basis of the actual audio object clustering.

Still in reference to FIG. 3, in addition to the cluster positions, the object-to-cluster gains are determined in step 320. It is noted that the object-to-cluster gains that are estimated in updating the cluster positions are just intermediate gains used to adjust the initial cluster positions. With the updated cluster positions, new object-to-cluster gains may be determined for grouping the audio objects into the clusters.

In step 320, object-to-cluster gains are determined based on the determined cluster positions, the object positions and the reference speaker layout. In embodiments disclosed herein, in order to preserve single channel quality, it is expected that the two-step process of clustering the audio objects into the clusters and rendering the resulted cluster signals to the speakers is equivalent to the process of directly rendering the audio objects to the speakers. Therefore, the object-to-cluster gains used to cluster the audio objects may be determined by minimizing the difference between the rendering of the cluster signals and the rendering of the audio objects according to the reference speaker layout.

Specifically, by applying a cluster rendering process, rendering gains for rendering the cluster signals according to the reference speaker layout and the cluster positions determined in the step 310 may be obtained. The obtained rendering gains for the cluster signals may be called cluster-to-speaker gains, each of which defines a proportion of the respective cluster signal that is panned to a speaker as specified by the reference speaker layout. Many panning techniques, either currently existing or to be developed in the future, may be used to estimate the cluster-to-speaker gains when the speaker positions in the speaker layout and the cluster positions are determined. Examples of panning techniques include, but are not limited to, VBAP, CMAP, pair-wise panning, and center-of-mass panning. The cluster signals can be combined by using corresponding cluster-to-speaker gains to obtain signals to be rendered by the speakers.

In addition, by applying an object rendering process, rendering gains for rendering the audio objects according to the reference speaker layout and the object positions may be obtained. The obtained rendering gains for the audio objects may be called object-to-speaker gains, each of which defines a proportion of the respective audio object that is panned to a speaker of the reference speaker layout. Any panning techniques may also be used to estimate the object-to-speaker gains based on the object positions and the speaker positions in the speaker layout. The audio objects can be combined by using corresponding object-to-speaker gains to obtain signals to be rendered by the speakers.

It is to be understood that the rendering gains for rendering cluster signals or audio objects may be utilized in the rendering process, but the cluster signals and the audio objects may not necessarily need to be actually rendered to the speakers in order to obtain the rendering gains. When the cluster positions and the object positions are known, it is possible to obtain cluster-to-speaker gains and the object-to-speaker gains by following certain criteria defined by well-known panning techniques, without actually rendering the cluster signals or the audio objects.

In some example embodiments disclosed herein, the object-to-cluster gains may be determined based on the obtained cluster-to-speaker gains and object-to-speaker gains. If a rendering error between the rendered signals obtained based on the cluster-to-speaker gains and the rendered signals obtained based on the object-to-speaker gains is relatively small, it means that the cluster rendering and the object rendering are equivalent. In this case, to achieve a small rendering error, it is expected that a combination of the object-to-cluster gains and the cluster-to-speaker gains used in the cluster rendering is substantially equal to the object-to-speaker gains used in the object rendering. That is, $$R_{os}=G_{oc}R_{cs} \tag{6}$$

where $R_{os}$ represents a matrix in which each element represents an object-to-speaker gain for panning an audio object o to a speaker s, $R_{cs}$ represents a matrix in which each element represents a cluster-to-speaker gain for panning a cluster c to a speaker s, and $G_{oc}$ represents a matrix of object-to-cluster gains to be determined.

As can be seen from Equation (6), the rendering error may be represented by, for example, a difference between $R_{os}$ and $G_{oc}R_{cs}$. It is desirable to determine the object-to-cluster gains ($G_{oc}$) by reducing or even minimizing this rendering error. In some use cases, the perceptual importance of the audio objects may be used during the cluster rendering and/or object rendering processes. Equation (6) can be modified by introducing the perceptual importance as a factor below:

$$E_oR_{os}=E_oG_{oc}R_{cs} \tag{7}$$

where $E_o$ represents a diagonal matrix in which each diagonal element represents the perceptual importance of an audio object o.

As can be seen from Equation (6) or Equation (7), in order to reduce the rendering error to an acceptable level, it is possible to set the object-to-cluster gains ($G_{oc}$) to suitable values based on the object-to-speaker gains ($R_{os}$), the cluster-to-speaker gains ($R_{cs}$), and/or the perceptual importance. In one example embodiment, the object-to-cluster gains may be estimated by applying a least square method to minimize the difference between the two terms in Equation (6) or Equation (7). Using Equation (7) as an example, the object-to-cluster gains may be calculated by determining the minimal Frobenius norm of the difference, which may be represented as follows:

$$\tilde{G}_{oc}=\min\|E_oR_{os}-E_oG_{oc}R_{cs}\|_F \tag{8}$$

where $\|\bullet\|_F$ represents the Frobenius norm, and $\tilde{G}_{oc}$ represents the determined object-to-cluster gains in a matrix form. In some other examples, the constraint that the object-to-cluster gains are always non-negative may be added in the gain determination. In this case, a gradient descent method or a non-negative least-square error (NNLSE) method may be applied to estimate the object-to-cluster gains.

Alternatively, or in addition, the speakers of the reference speaker layout may be assigned with different importance, which may also be considered in the object-to-cluster gain determination. For example, for a 7.1.4 speaker layout, the user may prefer to preserve speakers L, C, and R and thus these speakers may have higher importance and other speakers may bear lower importance. In this case, importance of the speakers as indicated by the reference speaker layout may be used as a factor to affect the determining process of the object-to-cluster gains. For example, by adding the importance of the speakers as a factor, the object-to-cluster gains may be calculated as follows:

$$\tilde{G}_{oc}=\min\|E_oR_{os}W_s-E_oG_{os}R_{cs}W_s\|_F \tag{9}$$

where $W_s$ represents an importance weight matrix of the speakers, which may be a dialog matrix with each element represents the importance of the respective speaker s in the reference speaker layout.

As mentioned above, multiple reference speaker layouts may be used to determine the clustering positions. In this case, the object-to-cluster gains may be determined with respect to each of the speaker layouts. In some example embodiments disclosed herein, the object-to-cluster gains may be determined based on all the reference speaker layouts, for example, by minimizing rendering errors for the speaker layouts. In other words, the cluster rendering and object rendering processes may be performed for each reference speaker layout, and then the object-to-cluster gains may be determined based on a sum of rendering errors between the cluster rendering processes and corresponding audio object rendering processes. Specifically, the object-to-cluster gains may be determined based on cluster-to-speaker gains and object-to-speaker gains obtained from those processes. It is noted that even if the cluster positions are determined based on only one reference speaker layout, multiple reference speaker layouts may be used for estimating the object-to-cluster gains.

Additionally, multiple reference speaker layouts may have their respective importance in the gain determining process. The importance may be preconfigured by, for example, the user. In some embodiments, some importance weights may be determined based on the importance of the reference speaker layouts and then used to calculate the object-to-cluster gains. In one example, the object-to-cluster gains may be calculated by adding the importance weight of the respective reference speaker layout as a factor, for example, as follows:

$$\tilde{G}_{oc}=\min\sum_{l=1}^{L}W_l\|E_oR_{os_l}-E_oG_{oc}R_{cs_l}\|_F \tag{10}$$

where L represents the number of the reference speaker layouts, $w_l$ represents a weight of a reference speaker layout l, $R_{os_l}$ represents a matrix of object-to-speaker gains determined by rendering the audio objects according to the reference speaker layout l, and $R_{cs_l}$ represents a matrix of cluster-to-speaker gains determined by rendering the cluster signals according to the reference speaker layout l. It will be appreciated that, in some other embodiments, the importance weights of the reference speaker layouts may also be jointly considered with the importance weights of the speakers in those layouts.

Based on the cluster positions determined in step 310 and the object-to-cluster gains determined in step 320, in the process 300 of FIG. 3, the audio objects are clustered for generating cluster signals in step 330. In some examples, the cluster signals may be stored for future use, or may be input to an encoder or translation process. In some other examples, the (encoded/translated) cluster signals may be transmitted to rendering systems. The cluster positions may be used as part of metadata of the cluster signals, so as to facilitate the subsequent rendering.

Figure 6:
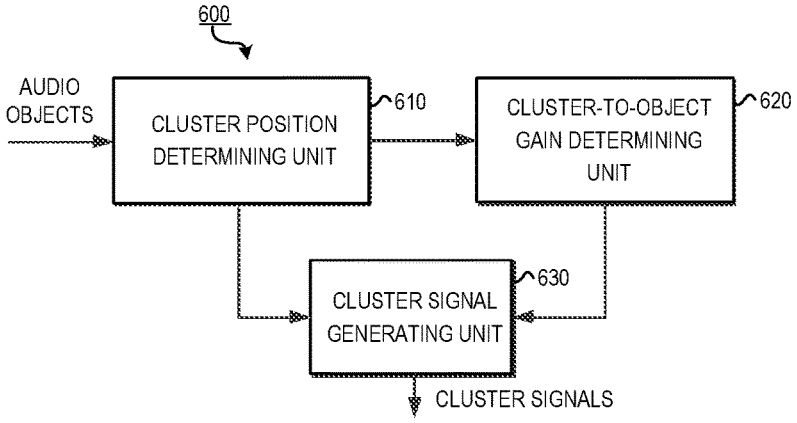
FIG. 6 is a block diagram of a system for clustering audio objects in accordance with one example embodiment disclosed herein.

FIG. 6 depicts a block diagram of a system for clustering audio objects 600 in accordance with one example embodiment disclosed herein. As shown, the system 600 includes a cluster position determining unit 610 configured to determine cluster positions based on object positions of the audio objects and a reference speaker layout, the reference speaker layout indicating speakers located at different speaker positions. The system 600 also includes an object-to-cluster gain determining unit 620 configured to determine object-to-cluster gains based on the determined cluster positions, the object positions and the reference speaker layout, an object-to-cluster gain defining a proportion of the respective audio object that is assigned to a cluster associated with one of the determined cluster positions. The system 600 further includes a cluster signal generating unit 630 configured to cluster the audio objects based on the object-to-cluster gains and the cluster positions for generating cluster signals.

Figure 7:
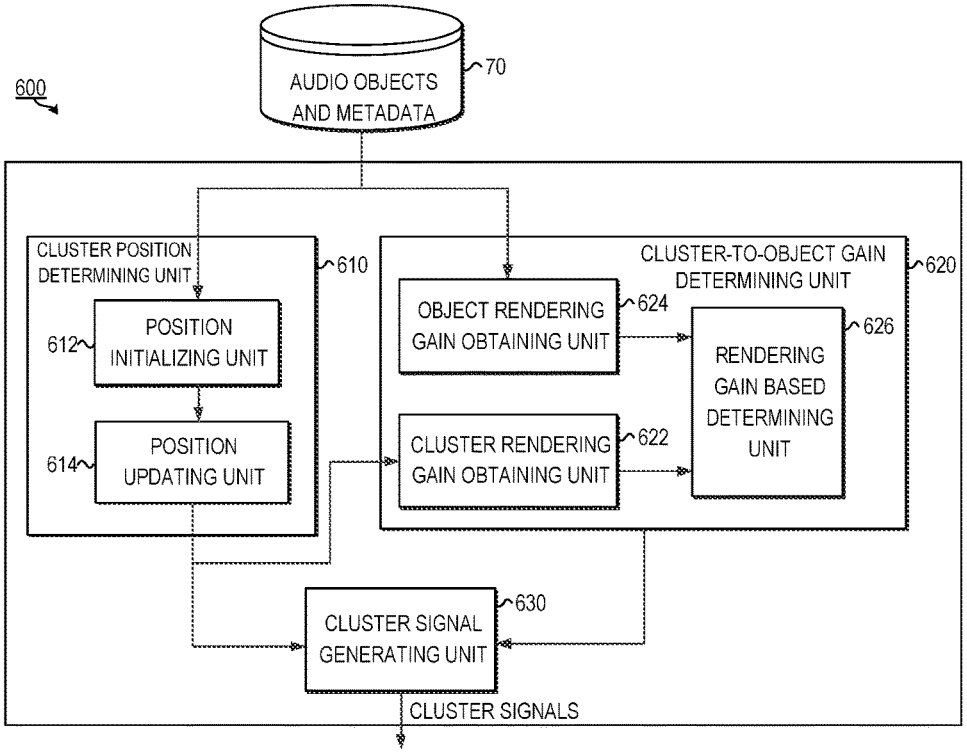
FIG. 7 is a block diagram of a system for clustering audio objects in accordance with another example embodiment disclosed herein.

FIG. 7 depicts a block diagram of a detailed example of the system 600 in accordance with some example embodiments disclosed herein. In some example embodiments disclosed herein, the audio objects may be produced by an authoring system 70 external to the system 600. The authoring system 70 may also provide metadata including object positions associated with the audio objects.

In some example embodiments disclosed herein, the cluster position determining unit 610 may include a position initializing unit 612 configured to determine initial cluster positions based on the reference speaker layout and a position updating unit 614 configured to determine the cluster positions by updating the initial cluster positions from the unit 612 based on the object positions.

In some example embodiments disclosed herein, the position initializing unit 612 may be configured to divide an area associated with the reference speaker layout into subareas based on at least one of the following perceptual importance of the audio objects, or a distribution of the audio objects in the area. The position initializing unit 612 may also be configured to determine the initial cluster positions based on locations of the subareas such that each of the speakers is addressed by at least one of clusters associated with the initial cluster positions.

In some example embodiments disclosed herein, the position initializing unit 612 may be configured to determine the initial cluster positions based on the speaker positions such that each of the speakers is addressed by at least one of clusters associated with the initial cluster positions.

In some example embodiments disclosed herein, the position updating unit 614 may be configured to determine intermediate gains based on the initial cluster positions and the object positions, an intermediate gain defining a proportion of the respective audio object that is assigned to a cluster associated with one of the initial cluster positions. The position updating unit 614 may also be configured to modify the intermediate gains based on a predetermined strategy, and update the initial cluster positions based on the modified intermediate gains.

In some example embodiments disclosed herein, the position updating unit 614 may be further configured to modify the intermediate gains based on at least one of the following: compressing the intermediate gains with a predetermined compression factor, increasing a difference between a first subset of the intermediate gains for a first initial cluster position of the initial cluster positions and a second subset of the intermediate gains for a second initial cluster position of the initial cluster positions, adjusting the intermediate gains based on distance weights, a distance weight being determined based on a distance between an initial cluster position and an object position of an audio object corresponding to the respective intermediate gain, or adjusting the intermediate gains based on perceptual importance of the audio objects.

In some example embodiments disclosed herein, the object-to-cluster gain determining unit 620, as shown in FIG. 7, may include a cluster rendering gain obtaining unit 622 configured to obtain a first set of rendering gains for rendering the cluster signals according to the reference speaker layout and the cluster positions from the unit 610, and an object rendering gain obtaining unit 624 configured to obtain a second set of rendering gains for rendering the audio objects according to the reference speaker layout and the object positions from the external system 70. The unit 620 may also include a rendering gain based determining unit 626 configured to determine the object-to-cluster gains based on the first and second sets of rendering gains. The cluster rendering gain obtaining 622 and/or the object rendering gain obtaining unit 624 may apply any panning techniques, either currently existing or to be developed in the future, to obtain the rendering gains for rendering the cluster signals and the audio objects.

In some example embodiments disclosed herein, the cluster position determining unit 610 may be further configured to determine the cluster positions based on a further reference speaker layout. In this case, the cluster rendering gain obtaining unit 622 may be configured to obtain a third set of rendering gains for rendering the cluster signals according to the further reference speaker layout and the cluster positions, and the object rendering gain obtaining unit 624 may be configured to obtain a fourth set of rendering gains for rendering the audio objects according to the further reference speaker layout and the object positions. Then the rendering gain based determining unit 626 may be configured to determine the object-to-cluster gains based on the first and second sets of rendering gains and the third and fourth sets of rendering gains.

In some example embodiments disclosed herein, the object-to-cluster gain determining unit 620, for example, the rendering gain based determining unit 626 in the unit 620, may be further configured to determine the object-to-cluster gains based on at least one of perceptual importance of the audio objects, importance of the speakers as indicated by the reference speaker layout, or importance of the reference speaker layout.

It is to be understood that the components of the system 600 may be a hardware module or a software unit module. For example, in some example embodiments, the system may be implemented partially or completely as software and/or in firmware, for example, implemented as a computer program product embodied in a computer readable medium. Alternatively, or in addition, the system may be implemented partially or completely based on hardware, for example, as an integrated circuit (IC), an application-specific integrated circuit (ASIC), a system on chip (SOC), a field programmable gate array (FPGA), and so forth. The scope of the subject matter disclosed herein is not limited in this regard.

Figure 8:
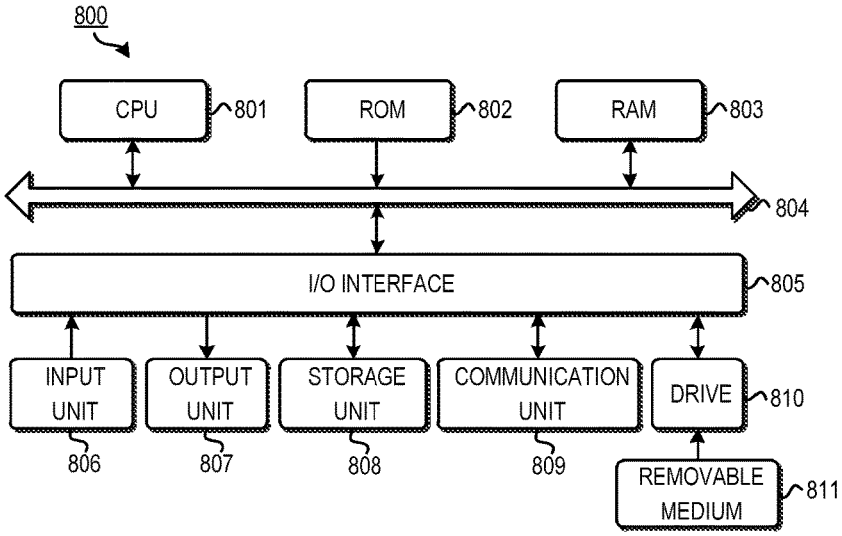
FIG. 8 is a block diagram of an example computer system suitable for implementing example embodiments disclosed herein.

FIG. 8 depicts a block diagram of an example computer system 800 suitable for implementing example embodiments disclosed herein. As depicted, the computer system 800 includes a central processing unit (CPU) 801 which is capable of performing various processes in accordance with a program stored in a read only memory (ROM) 802 or a program loaded from a storage unit 808 to a random access memory (RAM) 803. In the RAM 803, data required when the CPU 801 performs the various processes or the like is also stored as required. The CPU 801, the ROM 802 and the RAM 803 are connected to one another via a bus 804. An input/output (I/O) interface 805 is also connected to the bus 804.

The following components are connected to the I/O interface 805: an input unit 806 including a keyboard, a mouse, or the like; an output unit 807 including a display such as a cathode ray tube (CRT), a liquid crystal display (LCD), or the like, and a loudspeaker or the like; the storage unit 808 including a hard disk or the like; and a communication unit 809 including a network interface card such as a LAN card, a modem, or the like. The communication unit 809 performs a communication process via the network such as the internet. A drive 810 is also connected to the I/O interface 805 as required. A removable medium 811, such as a magnetic disk, an optical disk, a magneto-optical disk, a semiconductor memory, or the like, is mounted on the drive 810 as required, so that a computer program read therefrom is installed into the storage unit 808 as required.

Specifically, in accordance with example embodiments disclosed herein, the process described above with reference to FIG. 3 may be implemented as computer software programs. For example, example embodiments disclosed herein include a computer program product including a computer program tangibly embodied on a machine readable medium, the computer program including program code for performing the process 300. In such embodiments, the computer program may be downloaded and mounted from the network via the communication unit 809, and/or installed from the removable medium 811.

Generally speaking, various example embodiments disclosed herein may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments disclosed herein are illustrated and described as block diagrams, flowcharts, or using some other pictorial representation, it would be appreciated that the blocks, apparatus, systems, techniques or methods disclosed herein may be implemented in, as non-limiting examples, hardware, software, firmware, special purpose circuits or logic, general purpose hardware or controller or other computing devices, or some combination thereof.

Additionally, various blocks shown in the flowcharts may be viewed as method steps, and/or as operations that result from operation of computer program code, and/or as a plurality of coupled logic circuit elements constructed to carry out the associated function(s). For example, example embodiments disclosed herein include a computer program product including a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include, but not limited to, an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing.

Computer program code for carrying out methods disclosed herein may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server. The program code may be distributed on specially-programmed devices which may be generally referred to herein as "modules". Software component portions of the modules may be written in any computer language and may be a portion of a monolithic code base, or may be developed in more discrete code portions, such as is typical in object-oriented computer languages. In addition, the modules may be distributed across a plurality of computer platforms, servers, terminals, mobile devices and the like. A given module may even be implemented such that the described functions are performed by separate processors and/or computing hardware platforms.

As used in this application, the term "circuitry" refers to all of the following: (a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present. Further, it is well known to the skilled person that communication media typically embodies computer readable instructions, data structures, program modules or other data in a modulated data signal such as a carrier wave or other transport mechanism and includes any information delivery media.

Further, while operations are depicted in a particular order, this should not be understood as requiring that such operations be performed in the particular order shown or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of the subject matter disclosed herein or of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination.

Various modifications, adaptations to the foregoing example embodiments disclosed herein may become apparent to those skilled in the relevant arts in view of the foregoing description, when read in conjunction with the accompanying drawings. Any and all modifications will still fall within the scope of the non-limiting and example embodiments disclosed herein. Furthermore, other embodiments disclosed herein will come to mind to one skilled in the art to which those embodiments pertain having the benefit of the teachings presented in the foregoing descriptions and the drawings.

Accordingly, the present subject matter may be embodied in any of the forms described herein. For example, the following enumerated example embodiments (EEEs) describe some structures, features, and functionalities of some aspects of the subject matter disclosed herein.

EEE 1. A method of clustering audio objects includes: determining cluster positions based on object positions of the audio objects and one or more reference speaker layouts indicating reference speaker positions; and for said cluster positions, determining cluster signals by minimizing a metric representing a difference between rendering of audio objects according to the reference speaker layouts and rendering of cluster signals according to the reference speaker layouts.

EEE 2. The method according to EEE 1, the clusters positions are determined by determining initial cluster positions based on the reference speaker layouts and updating the initial cluster positions based on the audio object positions and a proportion of each audio object that is assigned to a cluster at the respective initial cluster position.

EEE 3. The method according to EEE 1, the initial cluster positions can be determined by at least one of the following: setting the initial cluster positions as the speaker positions in the reference speaker layouts; dividing an area associated with each of the speaker layouts into non-overlapping subareas; and determining the initial cluster positions based on the divided subareas.

EEE 4. The method according to EEE 3, the range of the subareas and the number of cluster for each subarea can be determined based on the distribution of the audio objects in the respective reference speaker layout.

EEE 5. The method according to any of EEEs 2 to 4, the proportion of each audio object to each cluster is computed by: computing a panning gain from each audio object to each cluster, modifying the panning gain to avoid the updated cluster position moving far from the initial cluster position, and determining the panning gain as the proportion of each audio object to each cluster, in which the updating can be based on one or multiple of the following: compressing the panning gain, adding a distance-based weight to the panning gain, or regularizing the panning gain.

EEE 6. The method according to any of EEEs 1 to 5, the metric can be minimized by any of Equations (8)-(10).

EEE 7. The method according to EEE 6, the metric is minimized by one of a non-negative least-square error (NNLSE) method, a least square method, or a gradient descent method.

It would be appreciated that the embodiments of the subject matter disclosed herein are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method of clustering audio objects, comprising:

determining initial cluster positions based on a reference speaker layout indicating speakers located at different speaker positions;

determining cluster positions based on the initial cluster positions and positions of the audio objects, by:

determining intermediate gains based on the initial cluster positions and the object positions, an intermediate gain defining a proportion of the respective audio object that is assigned to a cluster associated with one of the initial cluster positions;

modifying the intermediate gains based on a predetermined strategy; and updating the initial cluster positions based on the modified intermediate gains;

determining object-to-cluster gains based on the determined cluster positions, the object positions and the reference speaker layout, an object-to-cluster gain defining a proportion of the respective audio object that is assigned to a cluster associated with one of the determined cluster positions; and clustering the audio objects based on the object-to-cluster gains and the cluster positions for generating cluster signals.

2. The method according to claim 1, wherein determining the initial cluster position comprises:

dividing an area associated with the reference speaker layout into subareas based on at least one of the following:

perceptual importance of the audio objects, or a distribution of the audio objects in the area; and determining the initial cluster positions based on locations of the subareas such that each of the speakers is addressed by at least one of clusters associated with the initial cluster positions.

3. The method according to claim 1, wherein determining the initial cluster position comprises:

determining the initial cluster positions based on the speaker positions such that each of the speakers is addressed by at least one of clusters associated with the initial cluster positions.

4. The method according to claim 1, wherein modifying the intermediate gains comprises modifying the intermediate gains by at least one of the following:

compressing the intermediate gains with a predetermined compression factor;

increasing a difference between a first subset of the intermediate gains for a first initial cluster position of the initial cluster positions and a second subset of the intermediate gains for a second initial cluster position of the initial cluster positions;

adjusting the intermediate gains based on distance weights, a distance weight being determined based on a distance between an initial cluster position and an object position of an audio object corresponding to the respective intermediate gain; or adjusting the intermediate gains based on perceptual importance of the audio objects.

5. The method according to claim 1, wherein determining the object-to-cluster gains comprises:

obtaining a first set of rendering gains for rendering the cluster signals according to the reference speaker layout and the cluster positions;

obtaining a second set of rendering gains for rendering the audio objects according to the reference speaker layout and the object positions; and determining the object-to-cluster gains based on the first and second sets of rendering gains.

6. The method according to claim 5, wherein determining the cluster positions further comprises:

determining the cluster positions based on a further reference speaker layout, and wherein determining the object-to-cluster gains further comprises:

obtaining a third set of rendering gains for rendering the cluster signals according to the further reference speaker layout and the cluster positions, obtaining a fourth set of rendering gains for rendering the audio objects according to the further reference speaker layout and the object positions, and determining the object-to-cluster gains based on the first and second sets of rendering gains and the third and fourth sets of rendering gains.

7. The method according to claim 1, wherein determining the object-to-cluster gains further comprises:

determining the object-to-cluster gains based on at least one of perceptual importance of the audio objects, importance of the speakers as indicated by the reference speaker layout, or importance of the reference speaker layout.

8. A non-transitory computer-readable medium with instructions stored thereon that when executed by one or more processors cause a device to perform the method according to claim 1.

9. A device comprising:

a processing unit; and a memory storing instructions that, when executed by the processing unit, cause the device to perform the method according to claim 1.

10. A system for clustering audio objects, comprising:

a position initializing unit configured to determine initial cluster positions based on a reference speaker layout indicating speakers located at different speaker positions;

a position updating unit configured to determine cluster positions by:

determining intermediate gains based on the initial cluster positions and the object positions, an intermediate gain defining a proportion of the respective audio object that is assigned to a cluster associated with one of the initial cluster positions;

modifying the intermediate gains based on a predetermined strategy; and updating the initial cluster positions based on the modified intermediate gains;

an object-to-cluster gain determining unit configured to determine object-to-cluster gains based on the determined cluster positions, the object positions and the reference speaker layout, an object-to-cluster gain defining a proportion of the respective audio object that is assigned to a cluster associated with one of the determined cluster positions; and a cluster signal generating unit configured to cluster the audio objects based on the object-to-cluster gains and the cluster positions for generating cluster signals.

11. The system according to claim 10, wherein the position initializing unit is configured to:

divide an area associated with the reference speaker layout into subareas based on at least one of the following:

perceptual importance of the audio objects, or a distribution of the audio objects in the area; and determine the initial cluster positions based on locations of the subareas such that each of the speakers is addressed by at least one of clusters associated with the initial cluster positions.

12. The system according to claim 10, wherein the position initializing unit is configured to:

determine the initial cluster positions based on the speaker positions such that each of the speakers is addressed by at least one of clusters associated with the initial cluster positions.

13. The system according to claim 10, wherein the position updating unit is configured to modify the intermediate gains based on at least one of the following:

compressing the intermediate gains with a predetermined compression factor;

increasing a difference between a first subset of the intermediate gains for a first initial cluster position of the initial cluster positions and a second subset of the intermediate gains for a second initial cluster position of the initial cluster positions;

adjusting the intermediate gains based on distance weights, a distance weight being determined based on a distance between an initial cluster position and an object position of an audio object corresponding to the respective intermediate gain; or adjusting the intermediate gains based on perceptual importance of the audio objects.

14. The system according to claim 10, wherein the object-to-cluster gain determining unit comprises:

a cluster rendering gain obtaining unit configured to obtain a first set of rendering gains for rendering the cluster signals according to the reference speaker layout and the cluster positions;

an object rendering gam obtaining unit configured to obtain a second set of rendering gains for rendering the audio objects according to the reference speaker layout and the object positions; and a rendering gain based determining unit configured to determine the object-to-cluster gains based on the first and second sets of rendering gains.

15. The system according to claim 14, wherein the cluster position determining unit is further configured to determine the cluster positions based on a further reference speaker layout, and wherein the cluster rendering gain obtaining unit is configured to obtain a third set of rendering gains for rendering the cluster signals according to the further reference speaker layout and the cluster positions, the object rendering gain obtaining unit is configured to obtain a fourth set of rendering gains for rendering the audio objects according to the further reference speaker layout and the object positions, and the rendering gain based determining unit is configured to determine the object-to-cluster gains based on the first and second sets of rendering gains and the third and fourth sets of rendering gains.

16. The system according to claim 10, wherein the object-to-cluster gain determining unit is further configured to determine the object-to-cluster gains based on at least one of perceptual importance of the audio objects, importance of the speakers as indicated by the reference speaker layout, or importance of the reference speaker layout.

* * * * *